US008737875B2

(12) United States Patent
Tonges et al.

(10) Patent No.: US 8,737,875 B2
(45) Date of Patent: May 27, 2014

(54) DEVICES AND METHODS FOR RETRACTING A CARTRIDGE IN AN IMAGE FORMING DEVICE

(75) Inventors: Jeffrey Lawrence Tonges, Versailles, KY (US); Larry Steven Foster, Lexington, KY (US); William Paul Cook, Lexington, KY (US); Michael Hayes Wilson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 13/453,662

(22) Filed: Apr. 23, 2012

(65) Prior Publication Data

US 2012/0294650 A1 Nov. 22, 2012

Related U.S. Application Data

(62) Division of application No. 12/049,422, filed on Mar. 17, 2008, now Pat. No. 8,165,495.

(51) Int. Cl.

| | |
|---|---|
| ***G03G 15/04*** | (2006.01) |
| ***G03G 15/01*** | (2006.01) |
| ***G03G 21/16*** | (2006.01) |

(52) U.S. Cl.
USPC ..... 399/119; 399/111; 399/228; 399/231

(58) Field of Classification Search
USPC ..... 399/111, 119, 120, 223, 228, 231
See application file for complete search history.

(56) References Cited

U.S. PATENT DOCUMENTS

2007/0177899 A1 * 8/2007 Kawamura ..... 399/223

* cited by examiner

*Primary Examiner* — Joseph S Wong

(57) ABSTRACT

The present application is directed to methods and devices for moving a cartridge between engaged and disengaged positions in an image forming device. The image forming device may include a bias control arm movable between first and second positions. When the bias control arm is in one of the first and second positions, a biasing force on the cartridge is reduced and the cartridge moves to the disengaged position. When the bias control arm is in the other of the first and second positions, a biasing force on the cartridge is increased and the cartridge is moved to the engaged position. In one embodiment, the bias control arm moves in a first direction, and the cartridge moves in a second direction different than the first direction.

17 Claims, 16 Drawing Sheets

DEVICES AND METHODS FOR RETRACTING A CARTRIDGE IN AN IMAGE FORMING DEVICE

CROSS REFERENCE TO RELATED APPLICATION

Pursuant to 37 C.F.R. §1.78, this application is a divisional application and claims the benefit of the earlier filing date of application Ser. No. 12/049,422, filed Mar. 17, 2008 now U.S. Pat. No. 8,165,495, entitled "Devices and Methods for Retracting a Cartridge in an Image Forming Device," the contents of which are hereby incorporated by reference herein in their entirety.

BACKGROUND

The present application is directed to devices and methods for positioning a cartridge within an image forming device, and more particularly to devices and methods for selectively retracting a cartridge that is not being used to form a toner image.

Color image forming devices contain two or more cartridges, each of which transfers a different color of toner to a media sheet as required to produce a full color copy of a toner image. One common image forming device includes four separate cartridges for each of yellow, magenta, cyan, and black colors. Image formation for each cartridge includes moving the toner from a reservoir to a developer member, from the developer member to a photoconductive member, and from the photoconductive member to either a media sheet or an intermediate member. The toner images from each cartridge are formed on the media sheet in an overlapping arrangement that ultimately forms the final composite toner image.

In many devices, each cartridge is driven during image formation, even when one or more colors are not being used for the specific print job. When the cartridge is driven, the developer member forces toner through multiple compressive nips, even when the developer member is not actually transferring toner. Repeatedly passing toner through the compressive nips inflicts some level of damage to the toner. Worn or damaged toner particles may fail to transfer or may transfer too readily to the photoconductive member. Thus, each time a given particle of toner passes through a nip, the likelihood of that particle responding to the image formation process decreases.

SUMMARY

The present application is directed to methods and devices for moving a cartridge between engaged and disengaged positions in an image forming device. The image forming device may include a bias control arm movable between first and second positions. When the bias control arm is in one of the first and second positions, a biasing force on the cartridge is reduced and the cartridge moves to the disengaged position. When the bias control arm is in the other of the first and second positions, a biasing force on the cartridge is increased and the cartridge is moved to the engaged position. In one embodiment, the bias control arm moves in a first direction, and the cartridge moves in a second direction different than the first direction.

DETAILED DESCRIPTION

Figure 1:
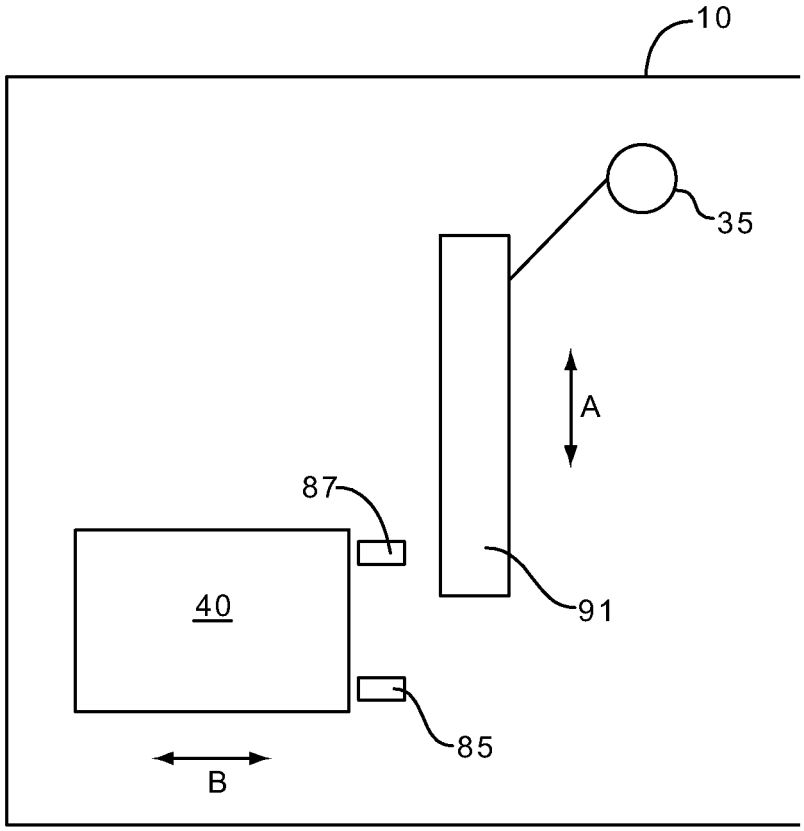
FIG. 1 is a schematic view of a cartridge and a bias control arm according to one embodiment.

The present application is directed to methods and devices for moving a cartridge in an image forming device. As illustrated in FIG. 1, a cartridge 40 is positioned within an image forming device 10 and is movable in the directions indicated by arrow B. The image forming device 10 may include one or more biasing members 85 and/or one or more electrical connectors 87 that engage and urge the cartridge 40 towards a first image-formation position. A bias control arm 91 is operatively connected to a motor 35 and is movable in the directions indicated by arrow A. The bias control arm 91 may contact and disengage one or more of the biasing members 85 and electrical connectors 87, and the cartridge 40 may move towards a second non-image formation position after the one or more biasing members 85 and electrical connectors 87 are disengaged.

Figure 2:
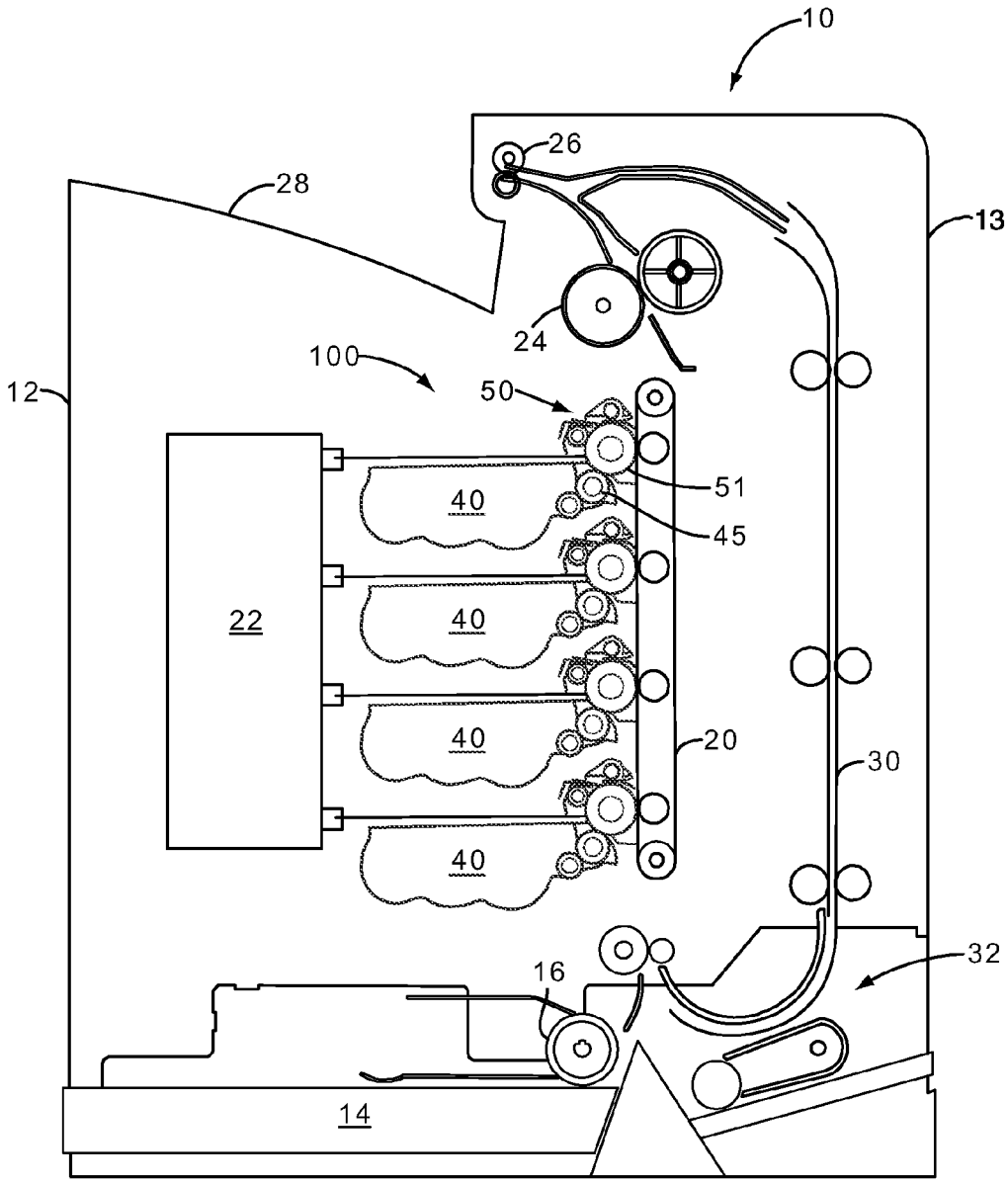
FIG. 2 is a schematic view of an image forming device according to one embodiment.

In order to better appreciate the context of the present application, FIG. 2 illustrates a representative image forming device, such as a printer, indicated generally by the numeral 10. The image forming device 10 comprises a main body 12 and a subunit 13. A media tray 14 with a pick mechanism 16 or a manual input 32 are conduits for introducing media sheets in the device 10. The media tray 14 is preferably removable for refilling, and located on a lower section of the device 10.

Media sheets are moved from the input and fed into a primary media path. One or more registration rollers disposed along the media path aligns the print media and precisely controls its further movement along the media path. A media transport belt 20 forms a section of the media path for moving the media sheets past a plurality of image forming units 100. Color printers typically include four image forming units 100 for printing with cyan, magenta, yellow, and black toner to produce a four-color image on the media sheet.

An imaging device 22 forms an electrical charge on a photoconductive member 51 within the image forming units 100 as part of the image formation process. The media sheet with loose toner is then moved through a fuser 24 that adheres the toner to the media sheet. Exit rollers 26 rotate in a forward or a reverse direction to move the media sheet to an output tray 28 or a duplex path 30. The duplex path 30 directs the inverted media sheet back through the image formation process for forming an image on a second side of the media sheet.

The image forming units 100 are constructed of a cartridge 40 (in this embodiment, a developer unit) and a photoconductor unit 50. The cartridge 40, including a developer member 45, is positioned within the main body 12. The photoconductor unit 50, including the photoconductive member 51, is mounted to the subunit 13. In a closed orientation as illustrated in FIG. 2, the subunit 13 is positioned adjacent to the main body 12 with the photoconductive member 51 of the photoconductor unit 50 against the developer member 45 of the cartridge 40.

Figure 3:
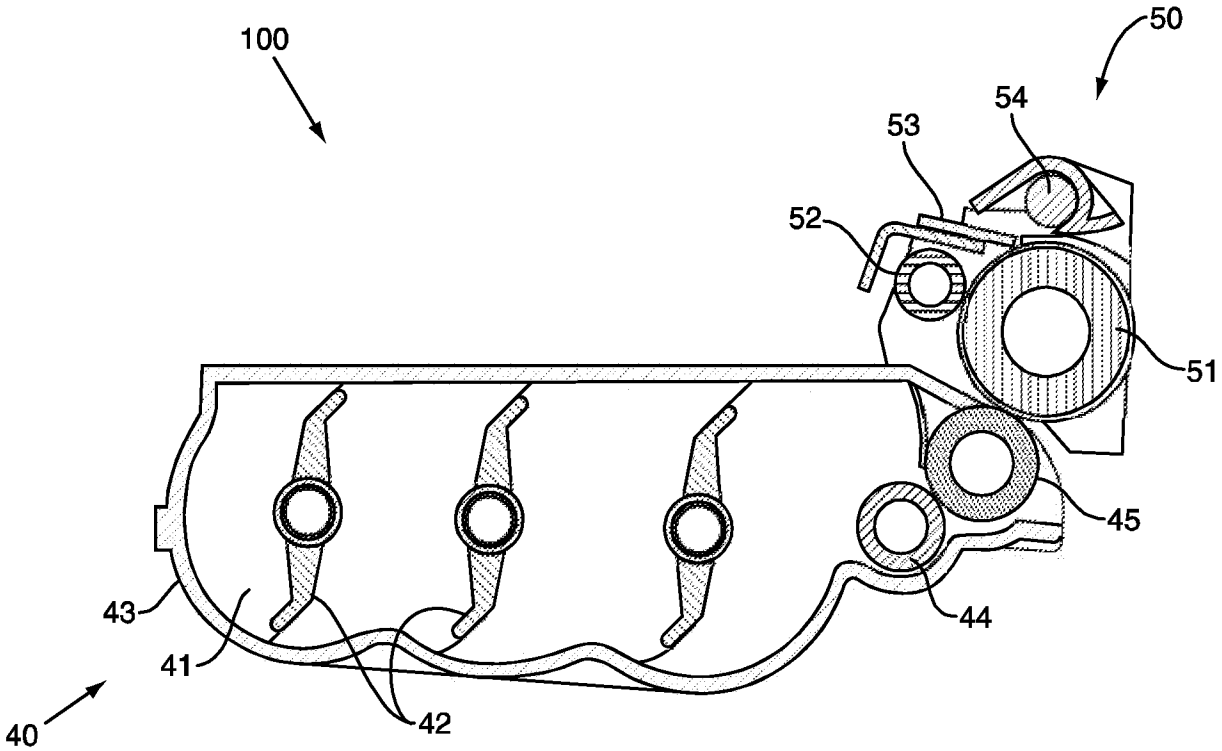
FIG. 3 is a cross-sectional view of an image forming unit according to one embodiment.
Figure 4:
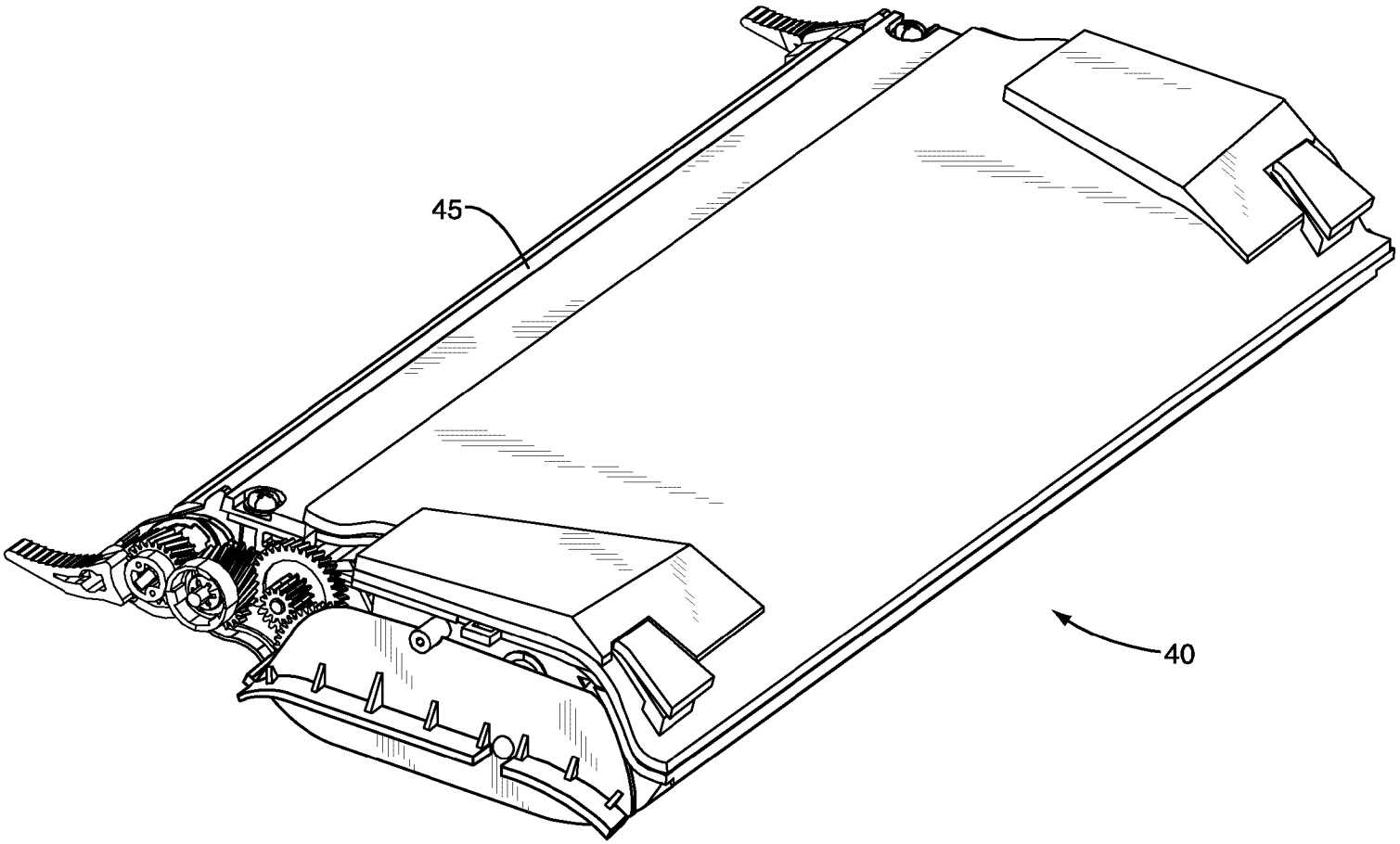
FIG. 4 is a perspective view of a developer unit according to one embodiment.

FIG. 3 illustrates a cross-sectional view of the image forming unit 100 in the closed orientation. The cartridge 40 comprises an exterior housing 43 that forms a reservoir 41 for holding a supply of toner. One or more agitating members 42 are positioned within the reservoir 41 for agitating and moving the toner towards a toner adder roll 44 and the developer member 45. Toner moves from the reservoir 41 via the one or more agitating members 42, to the toner adder roll 44, and finally is distributed to the developer member 45. The cartridge 40 is structured with the developer member 45 on an exterior section where it is accessible for being in contact with the photoconductive member 51 as illustrated in FIG. 4.

Figure 5:
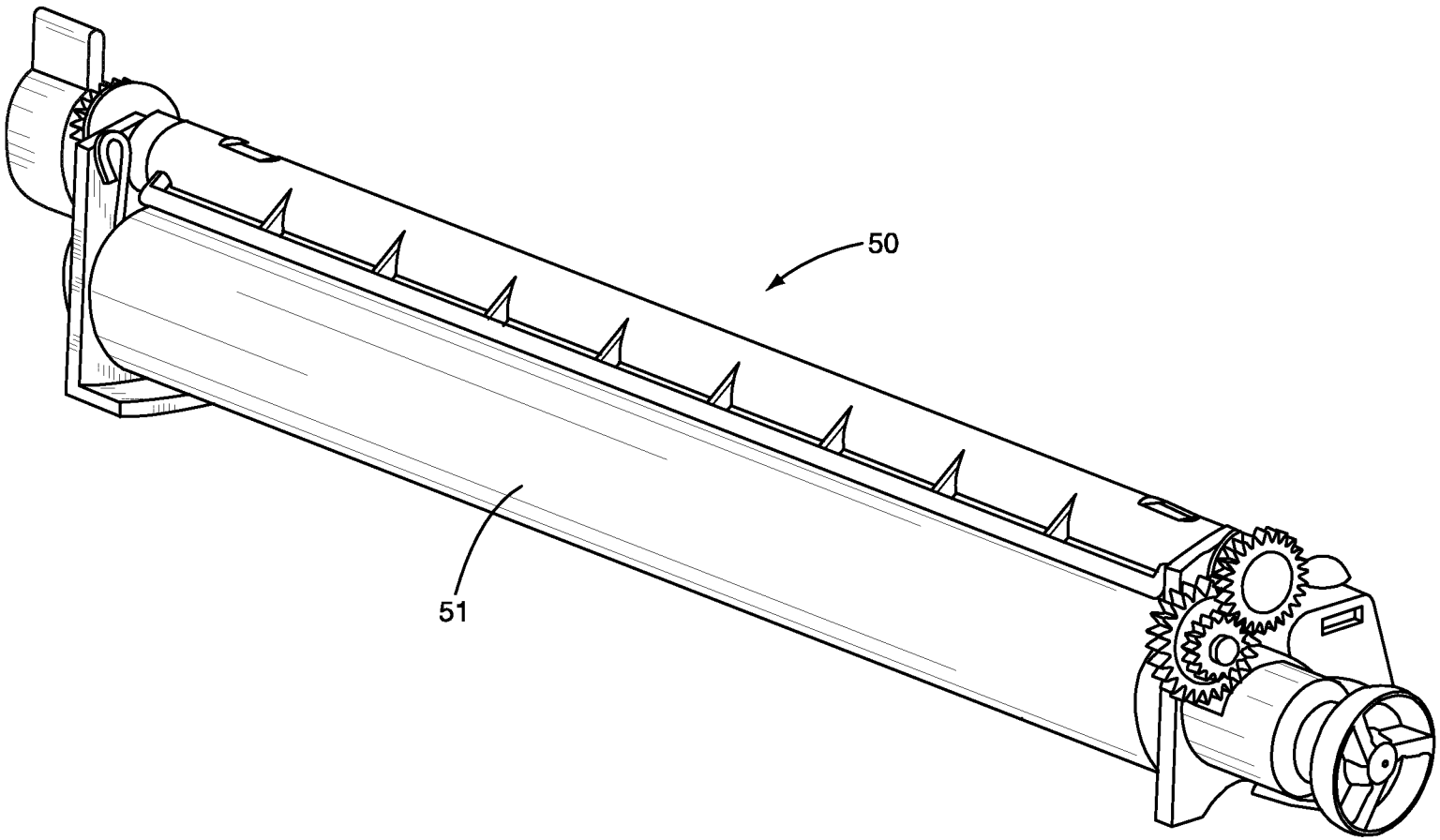
FIG. 5 is a perspective view of a photoconductor unit according to one embodiment.

The photoconductor unit 50 is illustrated in FIG. 3 and comprises the photoconductive member 51. The photoconductor unit 50 may also include a charger 52 that applies an electrical charge to the photoconductive member 51 to receive an electrostatic latent image from the imaging device 22. A cleaner blade 53 contacts the surface of the photoconductive member 51 to remove any toner that remains on the photoconductive member 51. The residual toner is moved to a waste toner auger 54 and moved out of the photoconductor unit 50. As illustrated in FIG. 5, the photoconductive member 51 is mounted on an exterior of the photoconductor unit 50 so it may be placed in contact with the developer member 45.

Figure 6:
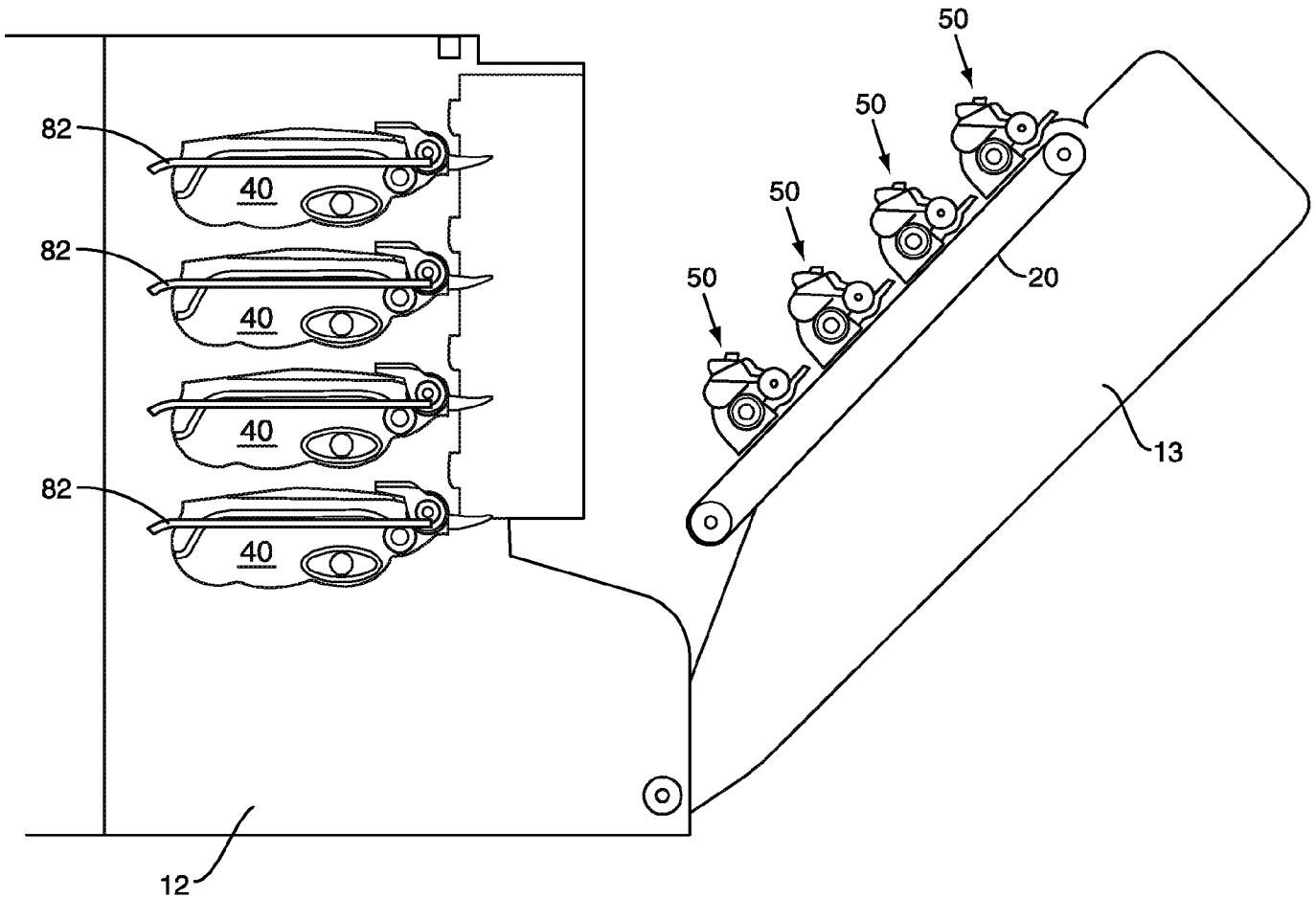
FIG. 6 is a cut-away side view of a subunit pivoted away from a main body of an image forming device according to one embodiment.

In an open orientation as illustrated in FIG. 6, the subunit 13 is moved away from the main body 12 separating the photoconductor unit 50 from the cartridge 40. This configuration provides direct and easy user access to the cartridge 40, photoconductor unit 50, and the media path. One embodiment of this two-piece cartridge design is described in U.S. Pat. No. 7,136,609 entitled "Movable Subunit and Two Piece Cartridge for Use in an Image Forming Device" issued on Nov. 14, 2006 and assigned to Lexmark International, Inc., the owner of the present application, and herein incorporated by reference in its entirety.

FIG. 6 also illustrates guide rails 82 extending from two sides of the cartridge 40. The guide rails 82 are used for mounting the cartridge 40 in the main body 12 of the image forming device 10. The main body 12 includes a plurality of rollers 83 that extend outward and support the guide rails 82. In one embodiment, a non-gear side (FIG. 7) of the cartridge 40 is supported by two rollers 83, and a gear side (FIG. 8) is supported by one roller 83. When fully inserted, a back edge of the cartridge 40 contacts against one or more biasing members 85. The biasing members 85 may apply a force outward from the main body 12 (i.e., towards the right as illustrated in FIG. 6). One embodiment of the biasing members 85 is described in U.S. Pat. No. 7,082,275 entitled "Variable Force Biasing Mechanism and Electrical Connection" issued on Jul. 25, 2006 and assigned to Lexmark International, Inc., the owner of the present application, and herein incorporated by reference in its entirety. In one embodiment, the biasing members 85 provide an electrical contact between the main body 12 and the cartridge 40. Various embodiments may include biasing members 85 providing both electrical and mechanical contact, only electrical contact, or only mechanical contact.

Figure 7:
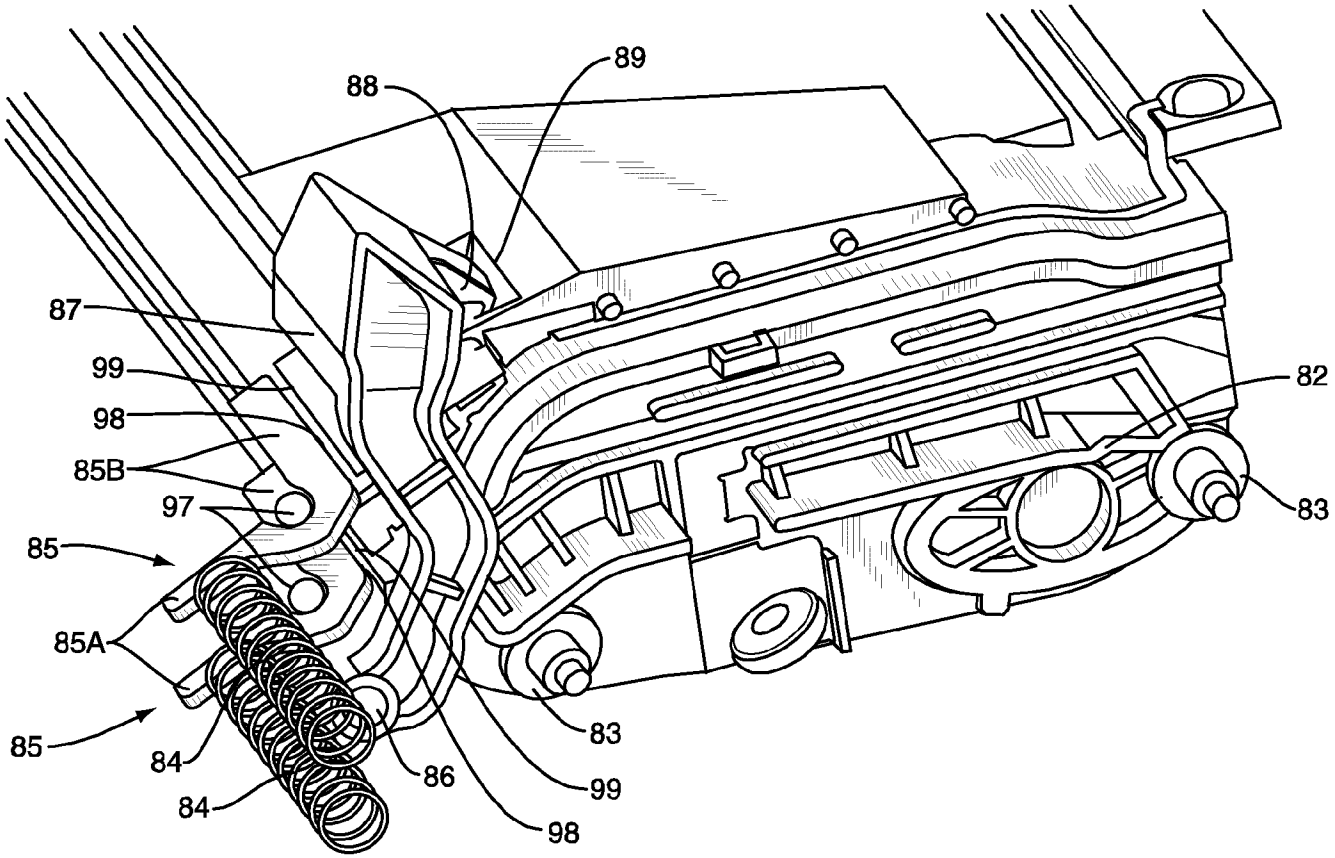
FIG. 7 is a partial perspective view of one side of a developer unit according to one embodiment.

FIG. 7 illustrates the cartridge 40 mounted in the main body 12 and in contact with the biasing members 85. The biasing member 85 may have a generally "L" shaped configuration, with a pivoting arm 85A pivotally disposed about a pivot member 97 and acted upon by a force generating member 84 (such as a spring). The pivot member 97 is rigidly affixed to the body 12 of the image forming device 10. As viewed in FIG. 7, the force generating member 84 causes the biasing member 85 to rotate in a clockwise direction. The biasing member 85 also includes a contacting arm 85B having a biasing edge 98. As the biasing member 85 rotates due to the action of the force generating member 84, the biasing edge 98 contacts the cartridge at contact surface 99.

When the subunit 13 is in the closed position, the photoconductive member 51 contacts the developer member 45 of the cartridge 40, thereby generating a nip force between the two members 45, 51. Because the guide rails 82 of the cartridge 40 are positioned on the rollers 83, the cartridge 40 may tend to roll away from the photoconductive member 51 due to the nip force. However, the biasing members 85 oppose movement of the cartridge 40 and maintain the nip force between the photoconductive member 51 and the developer roller 45.

Although described herein with respect to an image forming device 10 utilizing a photoconductive member 51 and developer member 45 in separate cartridge units, the present application is not limited to this embodiment. As those skilled in the art will readily recognize, the biasing member 85 is mounted within the main body 12 and applies a force against a separate component or member. That separate component or member may comprise a cartridge 40 housing a photoconductive member 51, a developer member 45, or both (or neither). In a cartridge 40 housing both a photoconductive member 51 and developer member 45, the nip force between the two may be controlled by applying a bias force to the cartridge 40 that is mechanically translated within the cartridge 40 to a nip force. Alternatively, it may urge the photoconductive member 51 of a cartridge 40 against an intermediate transfer belt or media sheet to transfer a developed image from the photoconductive member 51 to the belt or sheet.

Figure 8:
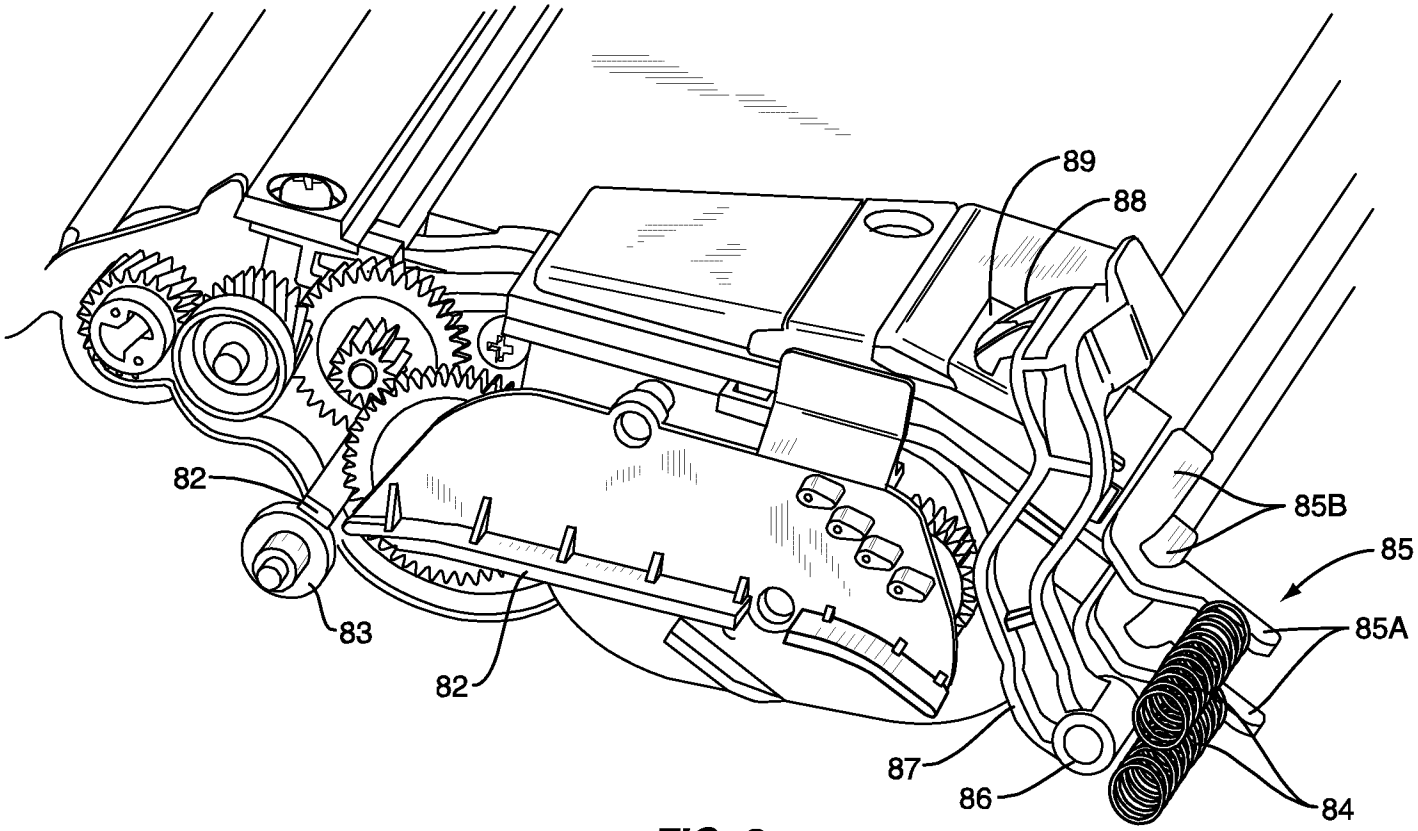
FIG. 8 is a partial perspective view of a second side of a developer unit according to one embodiment.

One or more electrical connectors 87 may also contact the cartridge 40. One embodiment includes two electrical connectors 87, one located in proximity to the non-gear side of the cartridge 40 as illustrated in FIG. 7, and the other located in proximity to the gear side of the cartridge 40 as illustrated in FIG. 8. One end of the electrical connector 87 is pivotably attached to the main body 12 at pivot 86. An end of the electrical connector 87 opposite from the pivot 86 includes a contactor 88 that engages the cartridge 40 at contact surface 89. A spring 77 (see FIG. 14) may contact the electrical connector 87 and cause counter-clockwise rotation about the pivot 86 as viewed in FIG. 8 and urge the electrical connector 87 into contact with the cartridge 40. One embodiment of the electrical connector 87 is described in U.S. patent application Ser. No. 11/964,347 entitled "Electrical Connector for an Image Forming Device" filed on Dec. 26, 2007 and assigned to Lexmark International, Inc., the owner of the present application, and herein incorporated by reference in its entirety.

The contactor 88 may provide electrical contact between the main body 12 and the cartridge 40 to deliver electrical power, charge, and/or data signals to and/or from components within the cartridge 40, such as a memory chip. In this embodiment, at least a portion of the contactor 88 and the contact surface 89 is constructed of an electrically conductive material. Each contactor 88 may provide a single electrical contact, or may provide multiple, distinct electrical contacts.

The contact surface 89 of the cartridge 40 may be recessed to facilitate engagement of the contactor 88 and the contact surface 89. As the cartridge 40 is mounted in the main body 12, the spring-loaded configuration of the electrical connector 87 causes the contactor 88 to "snap" into place in the recessed contact surface 89. Although generally significantly less than the biasing members 85, the electrical connector 87 may generate some amount of biasing force on the cartridge 40.

When the biasing members 85 and the electrical connectors 87 are in contact with the cartridge 40, the cartridge 40 is biased toward a printing (engaged) position in which the developer member 45 is in contact with the photoconductive member 51. As long as the cartridge 40 is in the printing position, the developer member 45 is rotated and the agitating members 42 churn the toner within the reservoir 41 through connection of at least one gear on the cartridge 40 with a drive gear of the main unit 12. These actions occur regardless of whether the toner in the reservoir 41 will be used during image formation of the present toner image (for example, color toner may not be used when printing an all black image).

It would be advantageous, then, to stop rotation of the developer member 45 and toner agitating members 42 when not required for the current image. This may prevent undesired consumption of color toner, as well as reduce the amount of toner churning. Before the developer member 45 and the agitating members 42 can be stopped, the cartridge 40 may have to be moved away from the printing position to a retracted position such that the developer member 45 is not in contact with the photoconductive member 51. One embodiment of a method for retracting the cartridge 40 is described in U.S. patent application Ser. No. 12/049,432 entitled "Methods to Control Transitions Between Color Printing and Black-Only Printing in an Image Forming Device" filed on Mar. 17, 2008 and assigned to Lexmark International, Inc., the owner of the present application, and herein incorporated by reference in its entirety. Additionally, one embodiment of a decision-making algorithm for when to retract the cartridge is described in U.S. patent application Ser. No. 12/049,407 entitled "Control Algorithms for Transitioning Between Color Printing and Black-Only Printing in an Image Forming Device" filed on Mar. 17, 2008 and assigned to Lexmark International, Inc., the owner of the present application, and herein incorporated by reference in its entirety.

Because the guide rails 82 of the cartridge 40 are supported by a plurality of rollers 83, the cartridge 40 may be free to slide along the rollers 83 in the absence of sufficient biasing force. Free movement of the cartridge 40 may be enhanced by sloping the guide rails 82 or the alignment of the rollers 83 such that gravitational forces cause the cartridge 40 to slide along the rollers 83 when the biasing forces are removed. Thus, by removing the biasing forces, the cartridge 40 may move away from the printing position, at which time the rotation of the developer member 45 and agitating members 42 may be stopped.

FIGS. 9A-D illustrate one embodiment of a bias control arm 91 operative to adjust the biasing force on one or more cartridges 40 within the main body 12. Bias control arm 91 comprises an elongated structure movable in the direction indicated by arrow A. The bias control arm 91 includes one or more positioning members 93 that translate the movement of the bias control arm 91 into movement of the cartridge 40 in the direction indicated by arrow B. The direction of arrow B is different than the direction of arrow A, and in one embodiment the directions are approximately perpendicular.

Figure 9A:
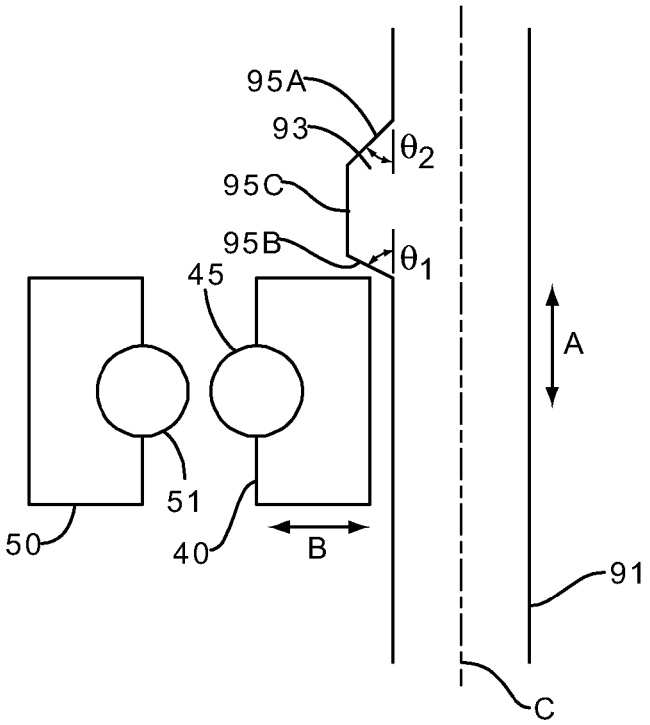
FIGS. 9A-9D are schematic views of a bias control arm contacting a cartridge according to one embodiment.
Figure 9B:
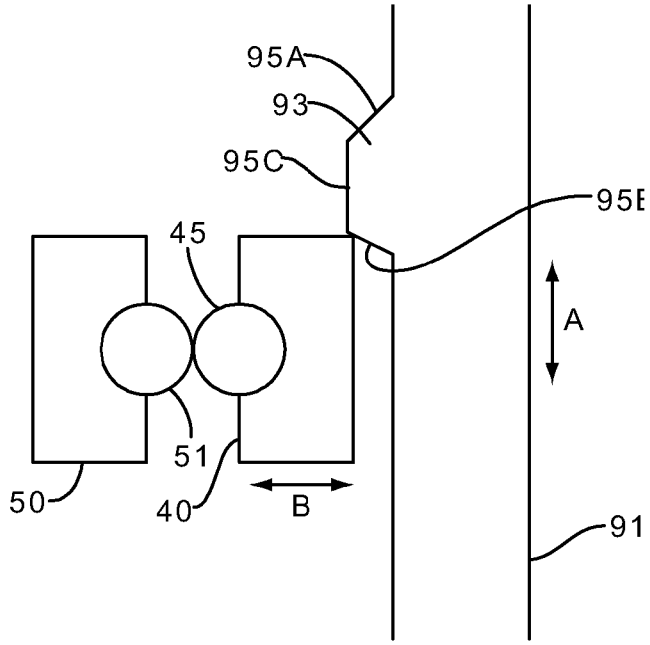
Figure 9C:
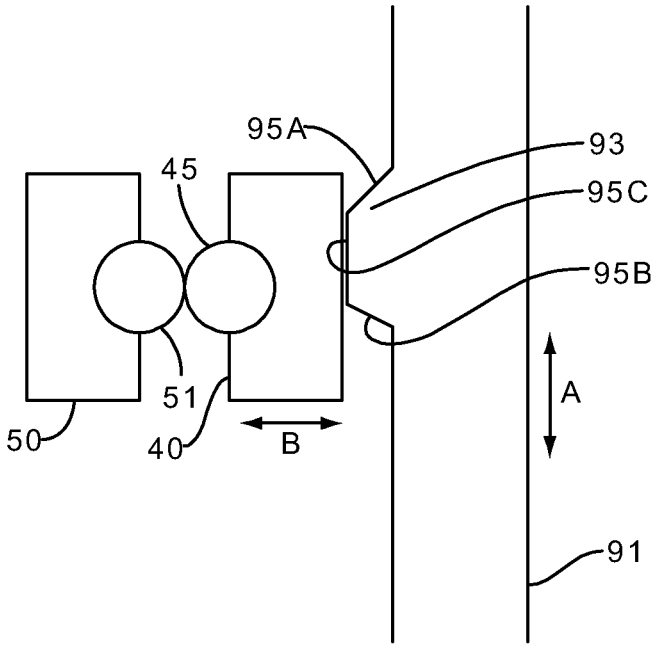

The translation of movement is affected by lower positioning surface 95B. As the bias control arm 91 moves downward as illustrated in FIG. 9A, the lower positioning surface 95B contacts the cartridge 40. The lower positioning surface 95B is oriented at an angle $\theta_1$ with respect to a centerline C of the bias control arm 91. As the bias control arm 91 continues to move downward, the angled lower positioning surface 95B exerts a biasing force on the cartridge 40 that pushes the cartridge 40 to the left as viewed in FIG. 9B until the developer member 45 contacts the photoconductive member 51. A minimum nip force may be generated when the developer member 45 and the photoconductive member 51 just touch. The downward movement of the bias control arm 91 may stop once developer member 45 and the photoconductive member 51 are in contact as illustrated in FIG. 9B, or may continue until a middle positioning surface 95C is in contact with the cartridge 40 as illustrated in FIG. 9C. A maximum nip force between the developer member 45 and the photoconductive member 51 may be generated when the middle positioning surface 95C is in contact with the cartridge 40. In one embodiment, an amount of downward movement of the bias control arm 91 depends on a desired nip force.

Figure 9D:
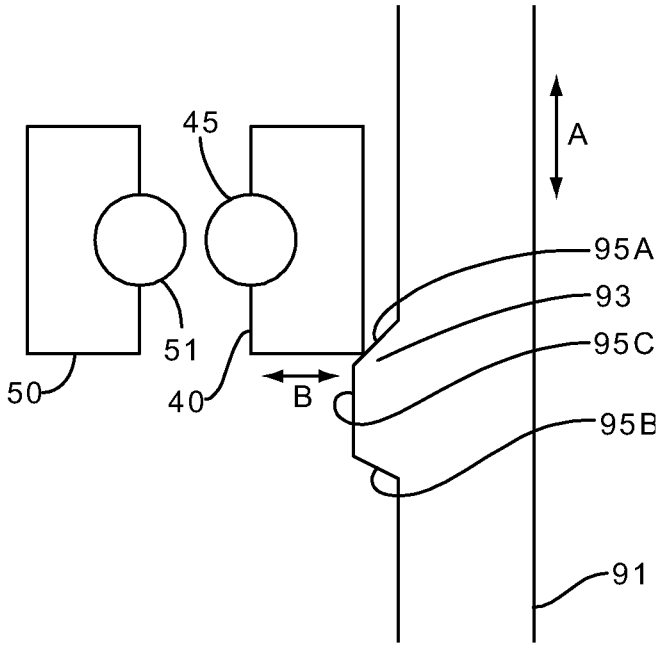

To lessen or remove the biasing force from the developer member 45, the bias control arm 91 may be moved upward to reverse the sequence illustrated in FIGS. 9A-C. Alternatively, the bias control arm 91 may be moved further downward until upper positioning surface 95A is in contact with the cartridge 40 as illustrated in FIG. 9D. The bias control arm 91 may be moved (upward or downward) until the biasing force is reduced to a level where the cartridge 40 moves away from the photoconductor unit 50, spacing the developer member 45 away from the photoconductive member 51.

The lower positioning surface 95B is oriented at an angle $\theta_1$ with respect to the centerline C of the bias control arm 91. As $\theta_1$ increases, the lower positioning surface 95B is oriented at a more severe angle to the cartridge 40. Larger values of angle $\theta_1$ result in more movement of the cartridge 40 in the direction of arrow B for each unit movement of the bias control arm 91 in the direction of arrow A (assuming that the bias control arm 91 moves at only one speed). Thus an amount of movement of the bias control arm 91 required to move the cartridge 40 and bring the developer member 45 into contact with the photoconductive member 51 with a desired nip force may be controlled by varying the angle $\theta_1$. In one embodiment, $\theta_1$ is an acute angle.

An angle $\theta_2$ at which the upper positioning surface 95A is oriented to the centerline C may be the same as or different than angle $\theta_1$. When $\theta_1$ and $\theta_2$ are different, the cartridge 40 may be moved at different speeds depending upon which positioning surface 95A, 95B is in contact with the cartridge 40. For example, if angle $\theta_1$ is less than angle $\theta_2$ and the bias control arm 91 follows the sequence illustrated in FIGS. 9A-D, then the cartridge 40 will be moved toward the photoconductor unit 50 (FIG. 9B) at a slower speed than it moves away from the photoconductive unit 50 (FIG. 9D), again assuming that the bias control arm 91 moves at the same speed throughout. In one embodiment, $\theta_2$ is an acute angle.

Figure 10:
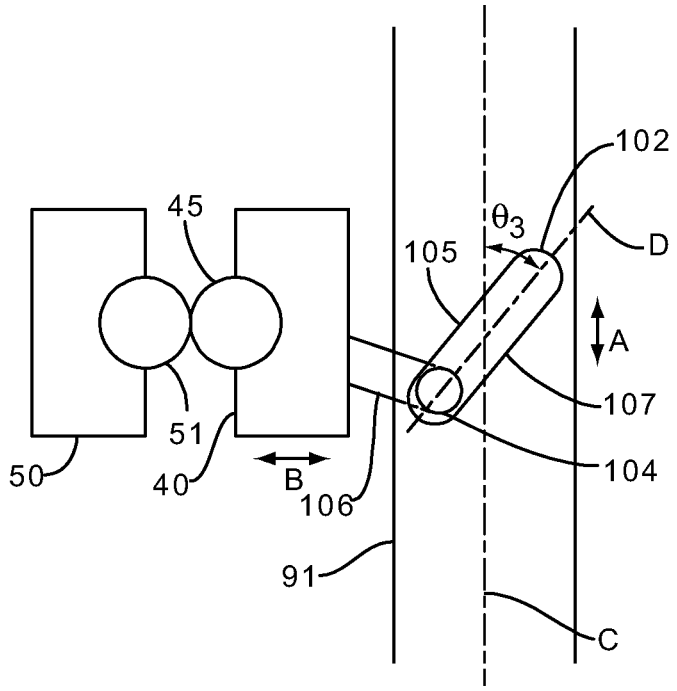
FIG. 10 is a schematic view of a bias control arm according to one embodiment.

In another embodiment as illustrated in FIG. 10, the angled positioning surface that causes the cartridge 40 to move in the direction of arrow A are located internally to the bias control arm 91 rather than on an outer surface as illustrated in FIGS. 9A-D. In this embodiment, one end of a connecting rod 106 is in contact with the cartridge 40, and another end is connected to a pin 104. The pin 104 is in communication with a slot 102 in the bias control arm 91. The slot 102 has a centerline D which is oriented at an angle $\theta_3$ to the centerline C of the bias control arm 91. Thus, as illustrated in FIG. 10, as the bias control arm 91 moves downward, the pin 104 is forced upward in the slot 102 by positioning surfaces 105, 107, and the cartridge 40 moves away from the photoconductor unit 50, and the developer member 45 is spaced apart from the photoconductive member 51. Conversely, as the bias control arm 91 moves upward, the pin 102 moves toward the lower end of the slot 102, and the developer member 45 is brought into contact with the photoconductive member 51. As the angle $\theta_3$ increases (that is, the centerline D becomes more horizontal as viewed in FIG. 10), a given amount of movement of the bias control arm 91 in the direction of arrow A results in less movement of the cartridge 40 in the direction of arrow B. In one embodiment, $\theta_3$ is less than or equal to about 90 degrees.

Figure 11:
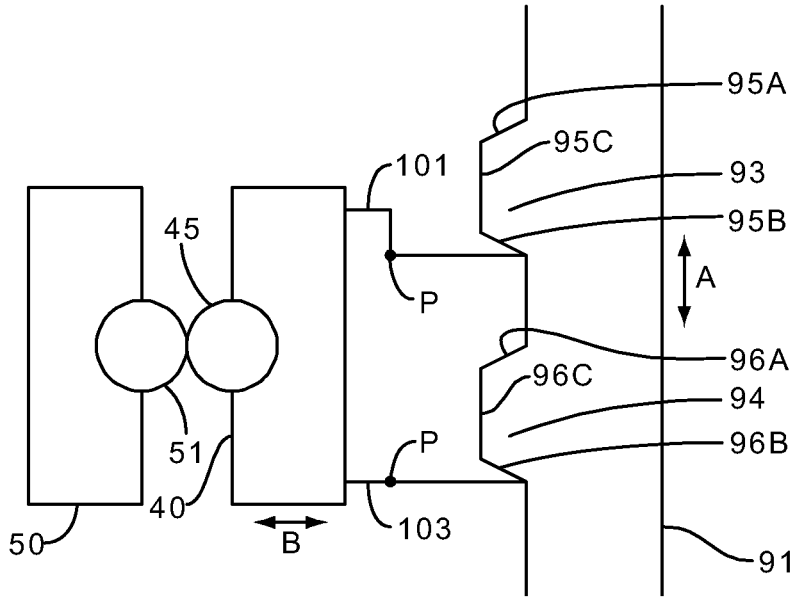
FIG. 11 is a schematic view of a bias control arm according to one embodiment.

While FIGS. 9A-D and 10 illustrate the bias control arm 91 directly providing the biasing force for the cartridge 40, in another embodiment one or more intermediate members may provide the biasing force, and the bias control arm 91 acts upon these intermediate members. FIG. 11 illustrates two members 101, 103 maintaining the cartridge 40 in a position such that the developer member 45 is in contact with the photoconductive member 51. While FIG. 11 illustrates both members 101, 103 present, other embodiments may include only one member 101, 103. Similar to the description above, as the bias control member moves downward as viewed in FIG. 11, lower positioning surfaces 95B, 96B of positioning members 93, 94 contact the members 101, 103. As the bias control arm 91 continues to move downward, the members 101, 103 pivot about pivot points P and at least partially retract from the cartridge 40. At some point, a force exerted by the members 101, 103 on the cartridge 40 decreases such that the cartridge 40 moves away from the photoconductor unit 50.

The bias control arm 91 may continue to move downward until the upper positioning surfaces 95A, 96A contact the members 101, 103. At this point, the members 101, 103 pivot in an opposite direction about pivot points P and exert a force on the cartridge 40 to move the developer member 45 back into contact with the photoconductive member 51. Alternately, the bias control arm 91 may move upward without the upper positioning surfaces 95A, 96A ever reaching the members 101, 103.

The two positioning members 93, 94 are illustrated in FIG. 11 as being on the same side of the bias control arm 91. However, any relative location of the positioning members 93, 94 may be used. For example, the positioning members 93, 94 may be oriented approximately 90 degrees (or some other angle) apart from one another around the bias control arm 91. The location of the positioning members 93, 94 may be influenced by the location of the members 101, 103 or the orientation of the bias control arm 91.

Figure 12:
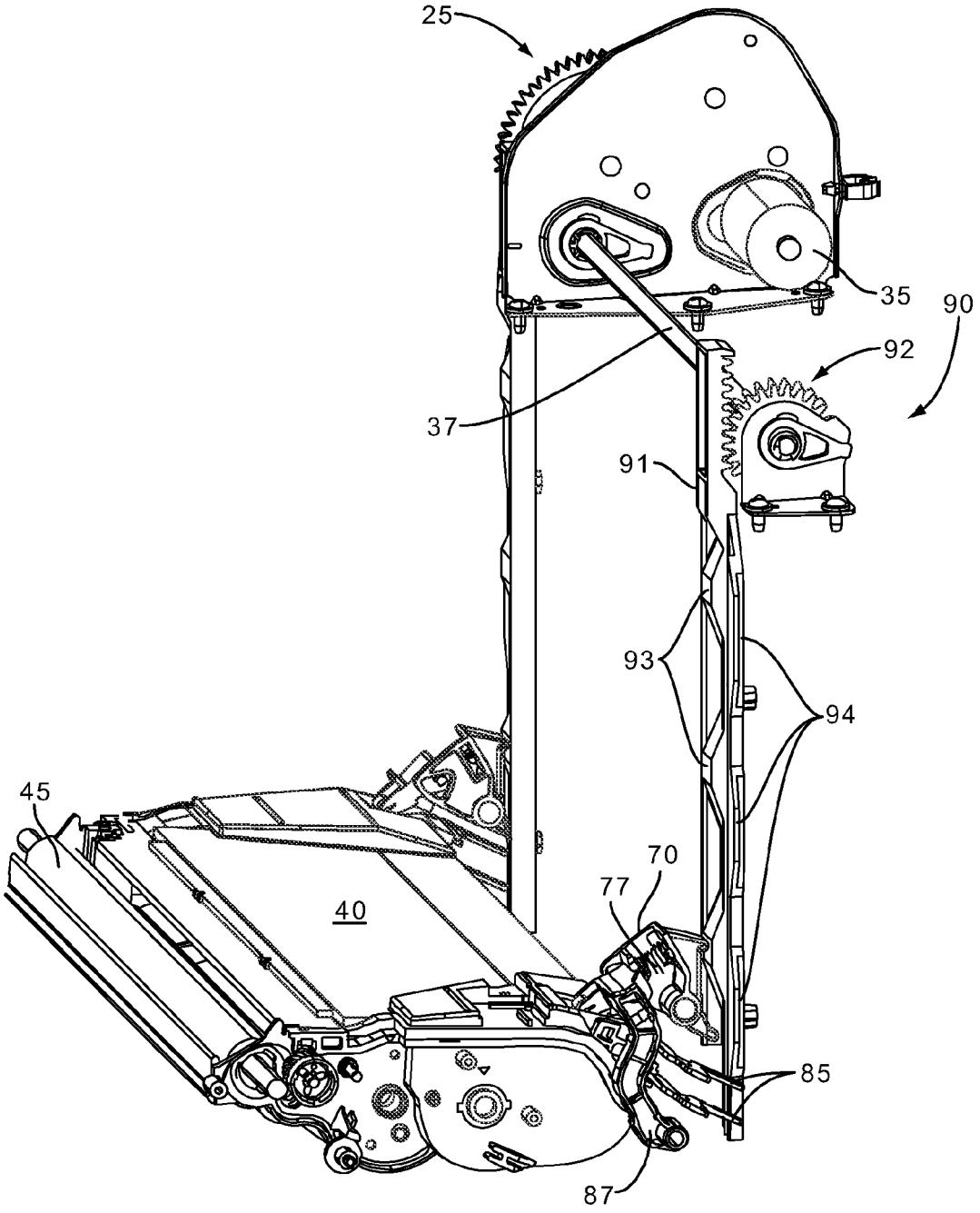
FIG. 12 is a perspective view of a system and a developer unit according to one embodiment.

FIG. 12 illustrates one embodiment of a subassembly 90 operative to remove or lessen the biasing force on one or more cartridges 40 within the main body 12. In this embodiment, two biasing members 85 and one electrical connector 87 contact opposite ends of the cartridge 40. The subassembly retracts one or more of the biasing members 85 and electrical connectors 87 from contact with the cartridge 40. The subassembly 90 includes a motor 35 operatively connected through a gear train 25 to a bias control arm 91. The bias control arm 91 is configured to selectively disengage one or more of the biasing members 85 and electrical connectors 87 from contact with the cartridge 40. As one or more of the biasing members 85 and electrical connectors 87 are disengaged, the biasing force exerted on the cartridge 40 is reduced until the cartridge 40 slides along the rollers 83 away from the printing position. For purposes of clarity, only a single cartridge 40 is illustrated in FIG. 9, although typically four cartridges would be in place in a vertical arrangement as illustrated in FIG. 2. The subassembly 90 may be configured to work on any or all of the cartridges 40. In one embodiment, the subassembly 90 is configured to retract the biasing members 85 and/or the electrical connectors 87 associated with the three color cartridges 40 (i.e., magenta, cyan, and yellow) in a four-color printer, but not the black cartridge 40.

The bias control arm 91 includes a first set of positioning members 93 disposed toward the cartridge 40, and a second set of positioning members 94 disposed at about 90 degrees from the first set of positioning members 93. The first set of positioning members 93 are operative to change the position of the electrical connectors 87, and the second set of positioning members 94 are operative to change the position of the biasing members 85 as discussed in greater detail below. The positioning members 93, 94 include angled positioning surfaces 95A, 95B, 96A, 96B (see FIGS. 13 and 14) that contact and at least partially retract either the biasing members 85 and/or the electrical connectors 87. As the biasing members 85 and/or the electrical connectors 87 are retracted, the biasing force on the cartridge is reduced until finally the cartridge 40 moves away from the photoconductor unit 50, and the developer member 45 is spaced apart from the photoconductive member 51.

Figure 13:
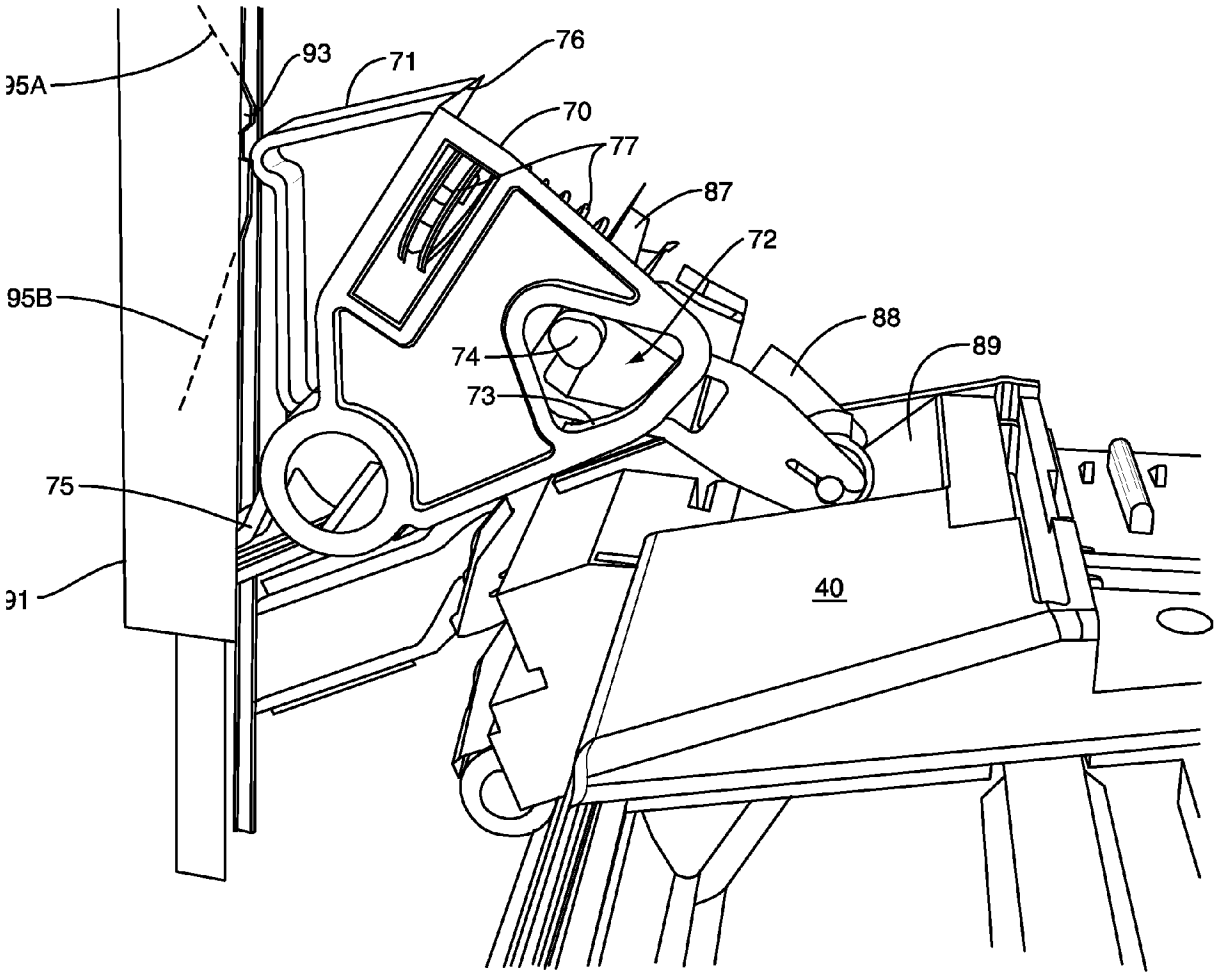
FIG. 13 is a partial perspective view of an upper positioning member and a developer unit according to one embodiment.

FIG. 13 illustrates one embodiment of how the bias control arm 91 interacts with the electrical connector 87. In this embodiment, the biasing members 85 and the electrical connector 87 are positioned such that the bias control arm 91 cannot directly contact both the biasing member 85 and the electrical connector 87. Therefore, an intermediate rotating member 70 is positioned to bridge the gap between the electrical connector 87 and the bias control arm 91. The intermediate rotating member 70 comprises an upper arm 71 and a lower arm 75, both of which contact the bias control arm 91. The intermediate rotating member 70 also includes a plate 76, and a spring 77 is oriented within a gap formed between the plate 76 and the electrical connector 87. The spring biases the electrical connector 87 towards the cartridge 40 such that the contactor 88 contacts the contact surface 89. The electrical connector 87 includes a pin 74 that extends into an opening 72 in the intermediate rotating member 70.

Activation of the motor 35 causes the bias control arm 91 to move downward as viewed in FIG. 13. The lower positioning surface 95B of the first positioning member 93 contacts the lower arm 75 of the intermediate rotating member 70 and continues to exert a force on the lower arm 75 as the bias control arm 91 moves downward. This force urges the intermediate rotating member 70 to rotate counterclockwise as viewed in FIG. 13. At about the same time, the upper positioning surface 95A moves adjacent to the upper arm 71 of the intermediate rotating member 70, which allows the counterclockwise movement to some extent. As the intermediate rotating member 70 rotates, an inner surface 73 of the opening 72 contacts the pin 74 and draws the electrical connector 87 and contactor 88 at least partially away from the cartridge 40. In one embodiment, the contactor 88 is moved apart from the contact surface 89. In another embodiment, the electrical connector 87 is retracted only enough to reduce the biasing force on the cartridge 40 without losing contact between the contactor 88 and the contact surface 89.

In another embodiment (not shown), the electrical connector 87 is positioned in proximity to the bias control arm 91 such that the first positioning member 93 may directly contact the electrical connector 87. In this embodiment, the intermediate rotating member 70 is not present, and contact by the first positioning member 93 causes the electrical connector 87 to at least partially retract from the cartridge 40.

Figure 14:
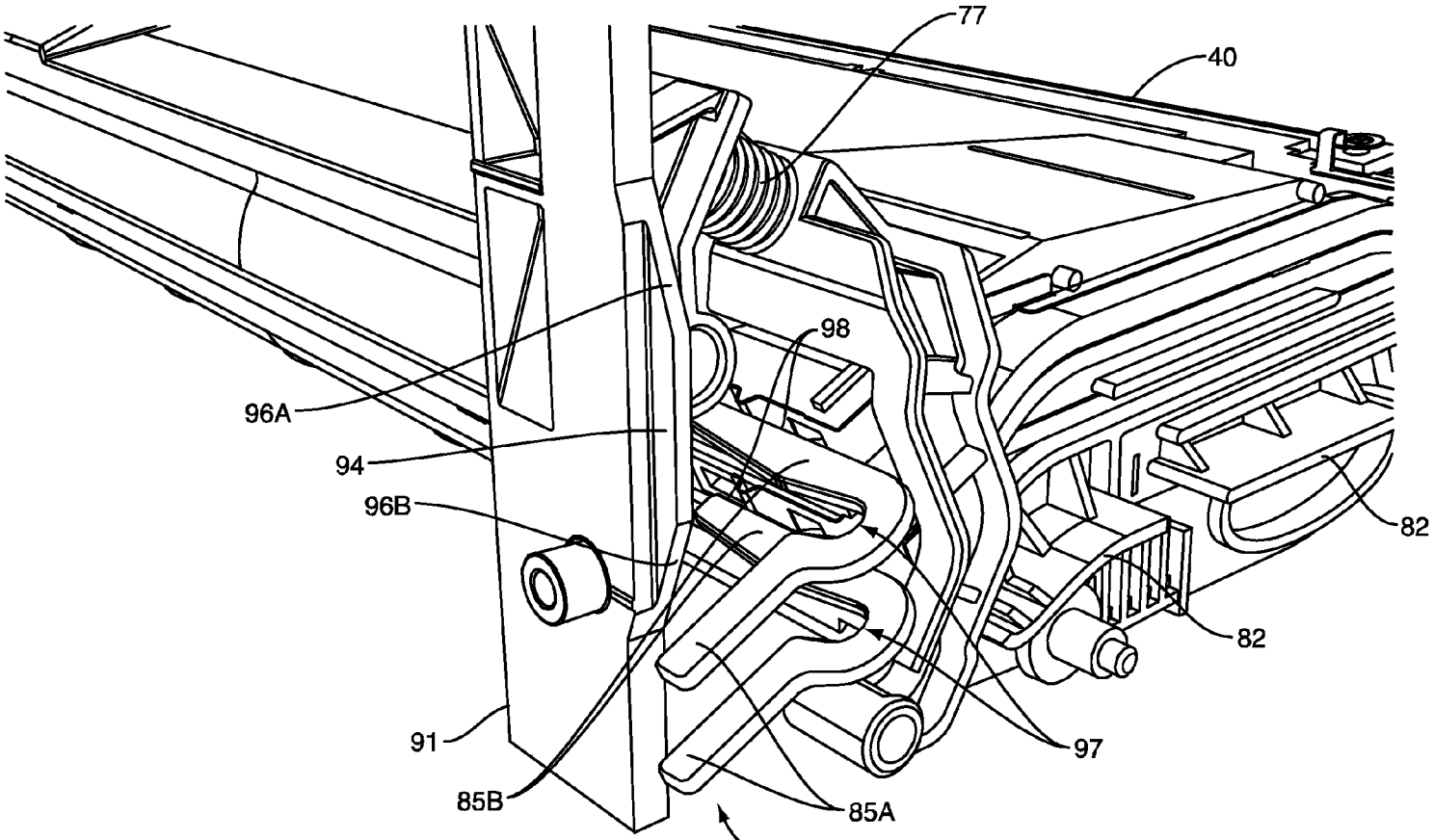
FIG. 14 is a partial perspective view of a side positioning member and a developer unit according to one embodiment.

Additionally, the second positioning member 94 at least partially disengages one or more of the biasing members 85 as illustrated in FIG. 14. As the bias control arm 91 moves downward, the lower positioning surface 96B contacts one or both of the biasing members 85. Continued downward movement of the bias control arm 91 causes the lower contact surface 96B to exert an outward force on the pivoting arm 85A of the biasing member 85, and the biasing member 85 pivots about pivot 97 in a direction opposite from the rotation caused by the force generating member 84 as illustrated in FIG. 8. Pivoting of the biasing member 85 results in the biasing edge 98 moving away from the contact surface 99 of the cartridge 40 when the outward force exceeds the force exerted by the force generating member 84, thereby reducing or eliminating the biasing force on the cartridge 40. In one embodiment, the upper positioning surface 96A of the second positioning member 94 may allow for the biasing member 85 to rotate back into contact with the cartridge 40 if the bias control arm 91 continues to move further downward. In another embodiment, the downward movement of the bias control arm 91 is stopped before the upper positioning surface 96A reaches the biasing member 85.

Figure 15:
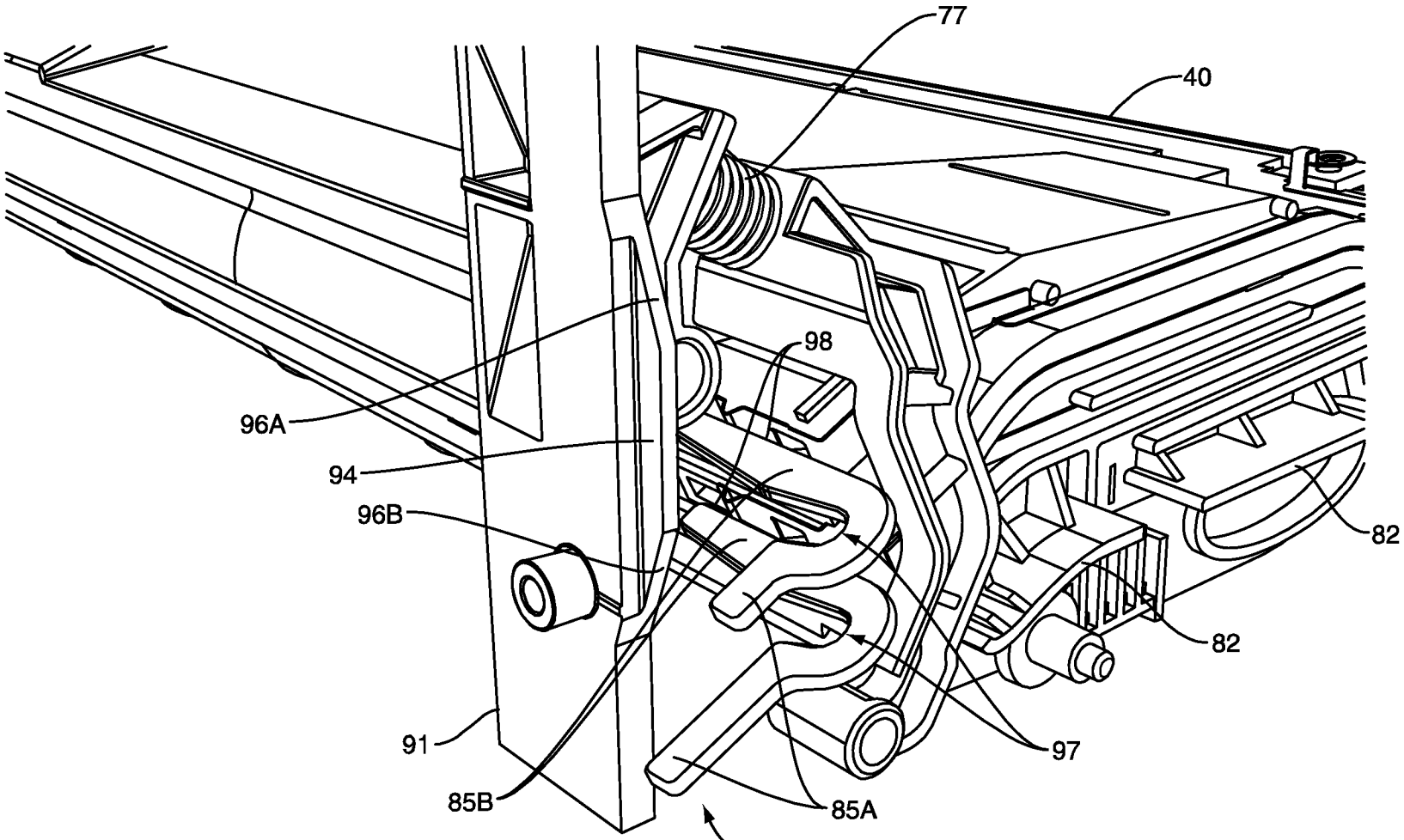
FIG. 15 is a partial perspective view of a side positioning member and a developer unit according to one embodiment.

In the embodiment illustrated in FIG. 14, the second positioning member 94 acts upon both of the biasing members 85. In other embodiments, it may be advantageous for the second positioning member 94 to act upon only one of the biasing members 85. This may be accomplished by limiting the downward movement of the bias control arm 91 so that the lower positioning surface 96B contacts only one biasing member 85. In another embodiment as illustrated in FIG. 15, one of the biasing members 85 is shortened so that is does not extend into the path of the second positioning member 94.

Once the one or more of the biasing members 85 and/or the electrical connectors 87 are at least partially retracted, the weight of the cartridge 40 may initiate movement of the cartridge 40 away from the photoconductor unit 50. As described previously, the cartridge 40 includes guide rails 82 supported by rollers 83. The guide rails 82 may be sloped such that cartridge 40 slides along the rollers 83 once the biasing forces of the biasing members 85 and electrical connectors 87 are reduced or removed. In another embodiment, only a portion of the biasing members 85 and/or the electrical connectors 87 are retracted by the subassembly 90. In this embodiment, the weight of the cartridge 40 may be great enough to overcome the force exerted by the non-retracted biasing members 85 and electrical connectors 87. In either case, the movement of the cartridge 40 positions the developer member 45 apart from the photoconductive member 51, and the rotation of the developer roller in the cartridge 40 may then be stopped.

Figure 16:
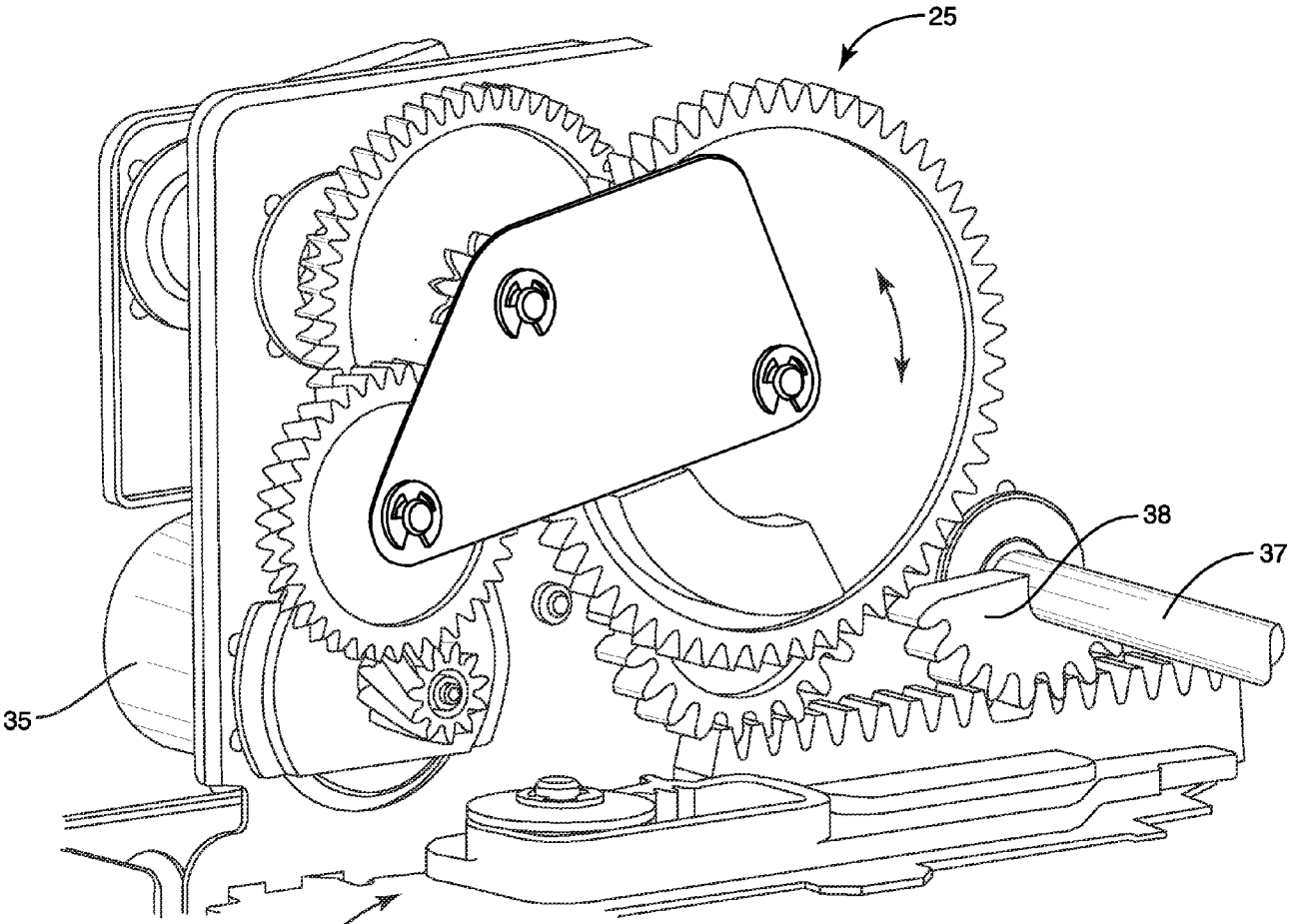
FIG. 16 is a partial perspective view of a motor and a gear train according to one embodiment.

FIG. 16 illustrates one embodiment of a gear train 25 that may be advantageously used for the present application. The motor 35 causes the gears of the gear train 25 to rotate, which in turn causes a drive rack 36 to move laterally. A gear 38 attached to a drive shaft 37 is engaged with the drive rack 36. As the drive rack 36 moves, the gear 38 and drive shaft 37 rotate. The drive shaft 37 may be connected at each end to a rack and pinion gear 92 as illustrated in FIG. 12. The rack portion of the rack and pinion gear 92 is formed on one end of the bias control arm 91. Rotation of the drive shaft 37, then, results in upward or downward movement of the bias control arm 91 as viewed in FIG. 9.

A variety of embodiments of the present application are possible to control the order in which the biasing members 85 and/or electrical connectors 87 are retracted. For example, electrical contact for the developer member 45 may be provided through one of the electrical connectors 87, and it may be desirable to maintain that electrical connection during separation until the developer member 45 is positioned away from the photoconductive member 51. In order to maintain this electrical contact, a position of the first positioning member 93 on the bias control arm 91 or the angle $\theta_1$, $\theta_2$ of the positioning surfaces 95A, 95B can be adjusted so that the electrical connector 87 is not retracted (if it is retracted at all) until the separation has occurred. In another example, one of the biasing members 85 may provide an electrical connection for the toner adder roll 44. It may be desirable to maintain the electrical contact for the toner adder roll 44 at all times. In one embodiment, continuous electrical contact may be achieved by shortening the pivoting arm 85A of the biasing member 85 as illustrated in FIG. 15 so that the biasing member 85 does not contact the second positioning member 94. The biasing mechanism 84 (see FIG. 7) urges the biasing member 85 towards the cartridge 40 throughout the range of movement of the cartridge 40. Thus, the positioning and shape of the first and second positioning members 93, 94 can be adjusted to achieve a desired sequence of retracting the biasing members 85 and electrical connectors 87.

Referring back to FIG. 8, the gear side of the cartridge 40 is illustrated. At least one of the gears mesh with a drive gear of the main unit 12 (not shown). As described above, the cartridge may have a range of motion between an engaged position where the developer member 45 and the photoconductive member 51 are in contact with one another and a retracted position where the developer member 45 and the photoconductive member 51 are spaced apart. In one embodiment, the gears of the cartridge remain meshed with the drive gear of the main unit 12. Thus, the developer member 45 and the agitating members 42 may be rotated or stopped from rotating at any desired point along the range of movement of the cartridge 40.

The term "image forming device" and the like is used generally herein as a device that produces images on a media sheet. Examples include but are not limited to a laser printer, ink-jet printer, fax machine, copier, and a multi-functional machine. One example of an image forming device is Model No. C530 from Lexmark International of Lexington, Ky.

The term "imaging device" refers to a device that arranges an electrical charge on the photoconductive element 51. Various imaging devices may be used such as a laser printhead and a LED printhead.

A transport belt 20 is illustrated in the embodiments for moving the media sheets past the image forming units 100, and as part of the subunit 13. In another embodiment, roller pairs are mounted to the subunit 13 and spaced along the media path. The roller pairs move the media sheets past the image forming units 100. In one embodiment, each of the roller pairs is mounted on the subunit 13. In another embodiment, one of the rollers is mounted on the subunit 13, and the corresponding roller of the pair is mounted on the main body 12. In yet another embodiment, rollers may be positioned within the photoconductor unit 50.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

What is claimed is:

1. A system for moving a cartridge between engaged and disengaged positions with a developer unit in an image forming device, comprising:

a bias control arm including an elongated shape along a centerline, the centerline oriented in a first direction, wherein the bias control arm is positioned in proximity to the cartridge and is linearly movable between first and second positions along the first direction; and a positioning surface located on a first side of the bias control arm and at an angular orientation to the centerline such that the positioning surface exerts a force on the cartridge generally perpendicular to the first direction when the bias control arm is in the second position thereby forming a nip between a developer member of the cartridge and a photoconductive member of the developer unit;

wherein the cartridge is in the disengaged position spaced away from the developer unit when the bias control arm is in the first position, and the cartridge is in the engaged position with the developer unit when the bias control arm is in the second position.

2. The system of claim 1, wherein the positioning surface comprises a portion of an outer surface of the bias control arm extending outward such that the positioning surface contacts the cartridge when the bias control arm linearly moves from the first position to the second position and exerts a biasing force on the cartridge.

3. The system of claim 2, wherein the positioning surface is oriented at an angle less than or equal to about 90 degrees to the centerline of the bias control arm.

4. The system of claim 1, wherein the positioning surface crosses the centerline of the bias control arm.

5. The system of claim 4, further comprising a connecting rod, a first end of the connecting rod in communication with the positioning surface and a second end of the connecting rod in contact with the cartridge.

6. The system of claim 1, wherein a length of the positioning surface is less than a length of the bias control arm along the centerline.

7. The system of claim 1, wherein the positioning surface is angled to the centerline such that the positioning surface translates the motion of the bias control arm in the first direction to movement of the cartridge between the engaged and disengaged positions in a second direction, the second direction different from the first direction.

8. The system of claim 7, wherein the second direction is generally perpendicular to the first direction.

9. A system for moving a cartridge between engaged and disengaged positions in an image forming device, comprising:

a biasing member in contact with the cartridge and urging the cartridge toward the engaged position with a developer unit;

a bias control arm including an elongated shape along a centerline, the centerline oriented in a first direction, wherein the bias control arm is positioned in proximity to the cartridge and linearly movable between first and second positions along the first direction;

a positioning surface located on a first side of the bias control arm and at an angular orientation to the centerline, the positioning surface spaced from the biasing member when the bias control arm is in the first position, and the positioning surface in contact with the biasing member when the bias control arm is in the second position; and when the bias control arm moves toward the first position, the cartridge moves in a second direction toward the disengaged position spaced away from the developer unit, the second direction different from the first direction.

10. The system of claim 9, wherein the positioning surface comprises a portion of an outer surface of the bias control arm extending outward such that the positioning surface contacts the biasing member when the bias control arm linearly moves from the first position to the second position.

11. The system of claim 9, wherein the bias control arm includes two or more positioning surfaces spaced along the bias control arm, each positioning surface oriented to contact a biasing member of a different cartridge.

12. The system of claim 9, wherein the second direction is generally perpendicular to the first direction.

13. The system of claim 9, comprising a second biasing member adjacent to the biasing member and separated from the biasing member by a gap, wherein a length of the positioning surface is greater than the gap such that the positioning surface simultaneously contacts the biasing member and the second biasing member.

14. The system of claim 1, wherein the positioning surface includes a lower positioning surface forming a first angle with respect to the centerline of the bias control arm, and an upper positioning surface forming a second angle with respect to the centerline of the bias control arm, the second angle different from the first angle.

15. The system of claim 1, further comprising a second positioning surface located on a second side of the bias control arm, the second side different from the first side, the second positioning surface at an angle relative to the centerline such that the second positioning surface exerts a force on the cartridge generally perpendicular to the first direction when the bias control arm is in the second position.

16. The system of claim 9, wherein the positioning surface includes a lower positioning surface forming a first angle with respect to the centerline of the bias control arm, and an upper positioning surface forming a second angle with respect to the centerline of the bias control arm, the second angle different from the first angle.

17. The system of claim 9, further comprising a second positioning surface located on a second side of the bias control arm, the second side different from the first side, the second positioning surface is at an angle relative to the centerline such that the second positioning surface exerts a force on the cartridge generally perpendicular to the first direction when the bias control arm is in the first position.

* * * * *